US007091419B2

(12) United States Patent
Müller

(10) Patent No.: US 7,091,419 B2
(45) Date of Patent: Aug. 15, 2006

(54) ELECTRICAL PLUG CONNECTOR

(75) Inventor: Bernd Müller, Muggensturm (DE)

(73) Assignee: BSH Bosch und Siemens Hausgeräte GmbH, Munich (DE)

( * ) Notice: Subject to any disclaimer, the term of this patent is extended or adjusted under 35 U.S.C. 154(b) by 0 days.

(21) Appl. No.: 10/774,875

(22) Filed: Feb. 9, 2004

(65) Prior Publication Data

US 2005/0000721 A1 Jan. 6, 2005

Related U.S. Application Data

(63) Continuation of application No. PCT/EP02/08895, filed on Aug. 8, 2002.

(30) Foreign Application Priority Data

Aug. 14, 2001 (DE) ..... 101 39 797

(51) Int. Cl.
*H01R 4/00* (2006.01)

(52) U.S. Cl. ..... 174/84 R; 174/84 S; 174/85

(58) Field of Classification Search ..... 174/74 R, 174/78, 84 R, 84 C; 29/863; 439/178, 179, 439/203, 880, 865, 866, 867–868, 936
See application file for complete search history.

(56) References Cited

U.S. PATENT DOCUMENTS 2,579,739 A * 12/1951 Hayes ..... 439/849
3,032,602 A * 5/1962 Farnell ..... 174/90
3,351,704 A * 11/1967 Sitzler ..... 174/84 R
4,142,771 A * 3/1979 Barnes et al. ..... 439/442
4,504,699 A * 3/1985 Dones et al. ..... 174/84 R
4,720,273 A * 1/1988 Thole ..... 439/592
4,971,758 A * 11/1990 Suzuki et al. ..... 420/472
5,532,433 A * 7/1996 Endo et al. ..... 174/84 C
5,828,007 A * 10/1998 Fujishita et al. ..... 174/120 R
6,730,848 B1 * 5/2004 Antaya et al. ..... 174/78

FOREIGN PATENT DOCUMENTS

GB 2 208 976 A 4/1989

* cited by examiner

*Primary Examiner*—William H. Mayo, III
(74) *Attorney, Agent, or Firm*—John T. Winburn; Russell W. Warnock; Craig J. Loest

(57) ABSTRACT

An electrical plug connector containing at least two contact partners which can be linked together in an overlap region to establish an electrical contact between them. At least one of the contact partners includes an electrically conductive material that converts to a liquid aggregation state at a predetermined temperature threshold. The liquid aggregation state is guided at least proportionately into the overlap region between the contact partners to establish the electrical contact.

6 Claims, 1 Drawing Sheet

ELECTRICAL PLUG CONNECTOR

BACKGROUND OF THE INVENTION

1. Field of the Invention

Figure 1:
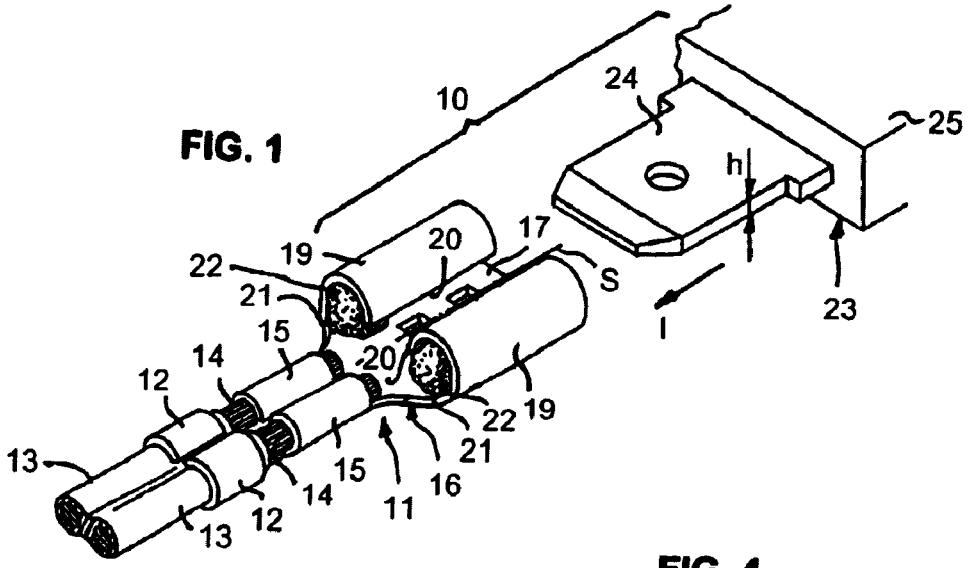

The invention relates to an electrical plug connector with at least two contact partners, which can be linked to establish an electrical contact.

2. Description of Related Art

Electrical plug connectors, for example comprising a receptacle and a flat plug, or similar electrical plug connectors are utilized in large numbers in electrical appliances of the consumer goods industry, such as for example large and small domestic appliances, socalled brown goods, or also in electrical appliances for do-it-yourself and trades needs or the like. Due to the large number of electrical contacts made between two plug contact partners there is the not insignificant danger in largescale manufacture in particular that the electrical conductivity of the electrical plug contact partners inserted by plugging in, for example through contact partners outside the manufacturing tolerance or otherwise faulty, is either not made at all or only inadequately between the joined contact partners. Due to the then high electrical resistance at the point of connection in the joined contact partners the deficient or unavailable electrical conductivity leads to considerable heating, which depending on the degree of unavailable conductivity and the thus increasing electrical resistance can lead into temperature ranges, which can trigger a so-called cable fire or even result in burning of the overall electrical appliance, when the latter is operated.

BRIEF SUMMARY OF THE INVENTION

The object of the invention is to eliminate the disadvantages of the prior art by taking simple structural measures.

This task is solved according to the invention by at least one of the contact partners being additionally provided with electrically conductive means, which transition into a liquid state of aggregation at an at least extensively preset temperature threshold and are guided at least proportionately into the overlap region between the contact partners and join the latter together electrically conductively.

Due to the inventive solution unacceptably high heating of the connection point between both contact partners leading to a cable fire or even an appliance fire is constantly prevented independently of manufacturing inadequacies and/or deficient work care on the part of the manufacturing personnel, since in the event of a fault the electrical conductivity between the connected contact partners is caused by electrically conductive means having for example a certain melting point, such as solder or the like. The melting point of the electrically conductive means serving to make the electrical connection between the contact partners can be selected variously, so that simple account can be taken of quite different degrees of heating at the interface between both contact partners. In addition, the measure according to the present invention can lead to a high standard of quality of the thus equipped products, without the need of 100% testing or selective testing within the scope of quality assurance with respect to the electrical conductivity of the electrical contact partners joined by plugging. As a result, the inventive solution contributes not inconsiderably to cost-effective manufacture of electrical appliances, whereby the cost reduction in particular clearly makes a significant difference to mass-produced electrical appliances, such as electrical domestic appliances or the like.

The means are designed particularly effectively, in particular with respect to their optimised use of material, if according to a preferred embodiment of the object of the invention it is provided that the means are converted into their initial liquid state at a temperature below the destructive temperature of the contact partners and/or the thus electrically contacted connecting cables.

According to another preferred embodiment of the object of the invention the means are arranged at least substantially outside the overlap region of both contact partners created by connecting.

Such arrangement of the electrically conductive means guarantees not only that both plug contact partners can be connected unhindered, but also offers the preference that the quantity of the means to be producing electrical conductivity can be increased within certain limits in order to always ensure that in the event of a fault and the associated rise in heat in the contacting region sufficient electrically conductive means, e.g. in the form of solder, can flow into the overlap region to produce electrical conductivity between both contact partners.

According to a subsequent preferred embodiment of the object of the invention the means are transported in the heated, liquefied state of aggregation into the overlap region.

The targeted supply of electrically conductive means to the region provided for contacting both plug contact partners ensures electrical contacting between both according to an original event of a fault.

The electrically conductive means can be fed particularly securely and defined into the region provided for contacting both contact partners, if according to an advantageous configuration of the object of the invention the liquefied electrically conductive means are transported into the overlap region via at least one channel designed at least approximately as capillaries.

The contact region between both electrical plug partners is supplied particularly securely and adequately in the event of a fault with electrically conductive means, if according to another preferred embodiment of the object of the invention several channels designed at least approximately as a capillary are provided, which terminate star-like in the overlap region of both contact partners.

In terms of manufacturing engineering, the capillaries are particularly easy and thus cost-effective to manufacture, if according to another preferred embodiment of the object of the invention the capillary is formed by a recess in one of the contact partners and a wall of the other contact partner covering the recess. Here, the recess can be produced cost-effectively e.g. by stamping in a manufacturing run along with manufacturing the plug contact partners.

The conductive electrical means are designed particularly favourably with respect to the selection options for the electrically conductive means on the one hand and with respect to the conductive properties on the other hand, if there is provision for the means to be designed as solder according to a next preferred embodiment of the object of the invention.

The solder is designed particularly effectively with respect to the fusion temperature of the solder and thus to the heating temperature of both contact partners in the event of a fault, if there is provision for the solder to be designed as soft solder according to a final preferred embodiment of the object of the invention.

BRIEF DESCRIPTION OF THE SEVERAL VIEWS OF THE DRAWING(S)

Figure 2:
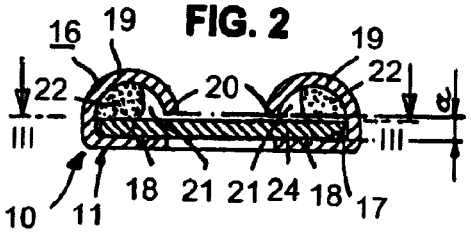
Figure 4:
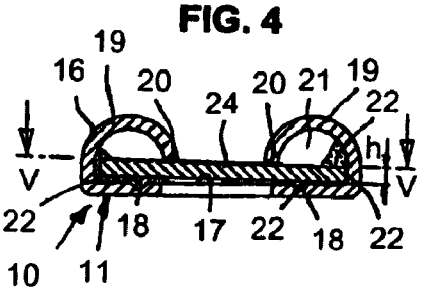
Figure 3:
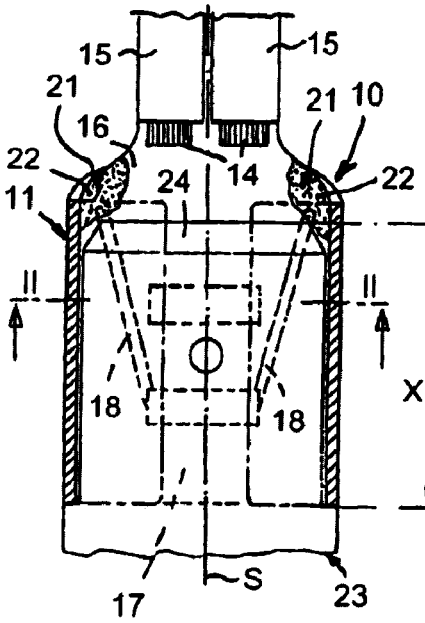
Figure 5:
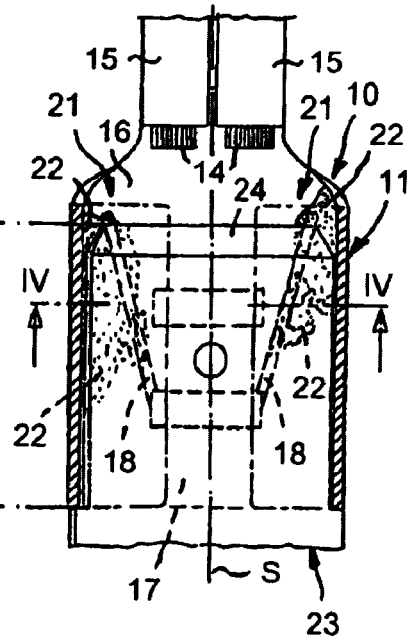

The invention is explained in greater detail and simplified in the following description through an example of a flat-profiled plug connector illustrated in the attached diagram, in which:

FIG. 1 shows an electrical plug connector in the disassembled state, with a flat plug and solder in the solid state in a receptacle holding a solder reservoir, in a plan view, FIG. 2 shows the electrical plug connector with the solder arranged in the solid state on the receptacle, and the flat plug inserted into the receptacle, in a front elevation, cut according to the line of intersection II—II, FIG. 3 shows the electrical plug connector in the connected state, according to FIG. 2, in the contact region, in a plan view, cut according to the line of intersection III—III, FIG. 4 shows the electrical plug connector in the connected state with solder run into the overlap region for contacting between the flat plug and the receptacle and fixed there, in a front elevation, cut according to the line of intersection IV—IV, and FIG. 5 shows the electrical plug connector in the connected state according to FIG. 4, in a plan view, cut according to the line of intersection V—V.

DETAILED DESCRIPTION OF THE INVENTION

According to FIG. 1 an electrical plug connector 10 is illustrated in the disassembled state with a receptacle 11 designed as a flat profile in the present case. The receptacle 11 has two adjoining line mounts 12 rolled into an annular contour. These aid in fastening plastic-sheathed line slots 13, which are insulated at their free end, so that their now freely accessible line cables 14 can be attached electrically conductively in contacting recesses 15 created by rounding and having a substantially circular opening cross-section. Connecting with the adjoining opposite recesses 15 the receptacle 11 has a sleeve section 16, which exhibits a bearing and guide section 17 designed in cross-section as a flat profile. Placed in these are two grooved depressions 18 made by forming of the guide section 17 without cutting (see FIG. 3 and FIG. 5). These are disposed symmetrically to a symmetrical axis S serving as middle line for the guide section 17 and in the present case have approximately ⅔ of the length of the guide section 17, whereby an end of the channel-like depressions 18 sits on the lateral edges of the ends of the guide section 17 facing the recesses 15, while the other end of the converging depressions 18 run in the direction of the symmetrical axis S. Apart from the depressions 18 the guide section 17 bears holding and reception sections 19, which are formed monobloc on the guide section 17 and are formed by rounding flat-profiled projections arranged laterally on both sides of the guide section 17. In the rolled state the holding and reception sections 19 exhibit a substantially circular cross-section, whereby their free ends 20, directed towards the bearing surface of the guide section 17, terminate at a distance "a" over the layer and guide face of the guide section 17. The holding and reception sections 19 have on their end section facing the recesses 15 a reservoir 21, which in the solid state of aggregation takes up electrically conductive means 22, such as for example solder based on soft solder DIN 1707 or DIN 1732 based on tin or according to DIN 1732 and 1735 based on silver.

As evident in particular from FIGS. 2 to 5, the receptacle 11 with its guide section 17 serves to receive a flat plug 23, which can be inserted into the guide section 17 in arrow direction I. The flat plug 23 is designed as a flat profile in cross-section and has a plug section 24, adapted substantially to the length of the guide section 17, whereof the height h is adapted at least approximately to the distance a between the free ends 20 of the support and guide face of the guide section 17 when the receptacle 11 or the flat plug 23 is in the finished state. Attached to the plug section 24 is a holding part 25 for electrically contacting wires or electrical terminals or the like, not shown in greater detail.

In the connected state the receptacle 11 and the flat plug 23 form an overlap region X, by linear matching of the plug section 24 to the guide section 17, in which the channel-like depressions 18 lie with at least the substantial part of their length. This adapting allows the channel-like depressions 18 to form, together with the underside of the plug section 24 facing them, at least extensively flat capillary-like channels. The opening cross-section of these capillary-like channels is matched to the viscosity of the electrically conductive means in the liquid state of aggregation to cause a type of automatic transport movement inside the capillary lengths to the overlap region X.

Where the receptacle 11, connected for the purpose of making electrical contact in terms of a plug connector 10 with the flat plug 23, e.g., for reasons of the holding and reception sections 19 lying outside permissible tolerance positions, namely an excessive distance "a" or other reasons, can cause no conductivity or only deficient electrical conductivity, the result is increased electrical resistance on the inserted components 11 and 23. Increasing the electrical resistance at an electrical voltage applied to the plug connector, e.g., when the electrical appliance is operating, again causes clear heating of the receptacle 11 or of the flat plug 23 made of heat-conducting and electrically conductive material, for example, copper, brass or the like. In this instance, when the melting point of the solder is exceeded, the solder stored inside the reservoir 21 is converted to the liquid state of aggregation and is guided through the channels 18 designed in the manner of capillaries into the overlap region X between the plug section 24 and the guide section 17. By transporting the solder into the overlap region between the flat plug 23 and the receptacle 11 both these components are connected to one another electrically conductively by the electrically conductive solder, causing the transition resistance to drop and thus, both these components to grow increasingly colder, so that the solder is again converted from its liquid into its solid state of aggregation and the electrical connection between the components 11 and 23 is made permanently.

The invention claimed is:

1. An electrical plug connector, comprising:

at least two contact partners which can be linked together in an overlap region to establish an electrical contact between said two contact partners;

at least one of two contact partners including an electrically conductive material, which material converts to a liquid aggregation state at a predetermined temperature threshold;

said material when converted to said liquid aggregation state is guided at least proportionately into said overlap region between said two contact partners to ensure said electrical contact between said two contact partners;

said contact partners including said electrically conductive material, further including a channel which substantially forms a capillary between said contact partners when linked together to guide said electrically conductive material in said liquid aggregation state into said overlap region;

said channel including at least a pair of capillary channels which terminate in a star-like formation in said overlap region and substantially form capillaries between said contact partners when linked together; and said capillary channels formed by a recess in one of said contact partners with a wall of the other one of said contact partners covering said recess to form said channel.

2. The electrical plug connector according to claim 1, including electrical cables electrically contacting said two contact partners and said electrically conductive material converts to said liquid aggregation state at a predetermined temperature threshold below the destructive temperature threshold of either said electrical cables or said two contact partners.

3. The electrical plug connector according to claim 1, including said electrically conductive material is located substantially outside of said overlap region.

4. The electrical plug connector according to claim 1, including said electrically conductive material is formed from a solder.

5. The electrical plug connector according to claim 4, including said electrically conductive material is formed from a soft solder.

6. An electrical plug connector, comprising:

at least two contact partners which can be linked together in an overlap region to establish an electrical contact between said two contact partners;

at least one of the two contact partners including an electrically conductive material, which material converts to a liquid aggregation state at a predetermined temperature threshold, said electrically conductive material being provided in an amount sufficient to be guided to contact the two contact partners when the two contact partners become heated to a temperature above a predetermined threshold as a result of electrical flow therebetween which results from an inadequate electrical connection causing increased resistance; and at least one guide including at least two grooved depressions forming recessed capillary channels in at least one of the two contact partners to guide the electrically conductive material in the liquid aggregation state into contact between the two contact partners to increase the electrical connection between the two contact partners to thereby decrease electrical resistance thereby cooling the two contact partners and causing the electrically conductive material to solidify.

* * * * *